US007553443B2

(12) United States Patent
Nakabayashi et al.

(10) Patent No.: US 7,553,443 B2
(45) **Date of Patent: *Jun. 30, 2009**

(54) METAL POWDER PRODUCTION APPARATUS

(75) Inventors: Koei Nakabayashi, Hachinohe (JP); Mitsutoyo Tanaka, Chino (JP); Tokihiro Shimura, Hachinohe (JP); Yoshinari Tanaka, Hachinohe (JP)

(73) Assignee: Seiko Epson Corporation (JP)

( * ) Notice: Subject to any disclaimer, the term of this patent is extended or adjusted under 35 U.S.C. 154(b) by 232 days.

This patent is subject to a terminal disclaimer.

(21) Appl. No.: 11/641,421

(22) Filed: Dec. 19, 2006

(65) Prior Publication Data

US 2007/0138711 A1 Jun. 21, 2007

(30) Foreign Application Priority Data

Dec. 20, 2005 (JP) ..... 2005-367228

(51) Int. Cl.
*C21C 1/00* (2006.01)
*B22F 9/06* (2006.01)

(52) U.S. Cl. ..... 266/202; 75/343

(58) Field of Classification Search ..... 266/202; 251/342, 11; 72/342.5, 342.6
See application file for complete search history.

(56) References Cited

U.S. PATENT DOCUMENTS 4,624,409 A 11/1986 Takeda et al.
5,058,856 A * 10/1991 Gordon et al. ..... 251/11
5,366,204 A 11/1994 Gigliotti, Jr. et al.

FOREIGN PATENT DOCUMENTS

JP 03-55522 8/1991

* cited by examiner

*Primary Examiner*—Melvin C Mayes
*Assistant Examiner*—James Corno
(74) *Attorney, Agent, or Firm*—Harness, Dickey & Pierce, P.L.C.

(57) ABSTRACT

A metal powder production apparatus includes a supply part for supplying molten metal and a nozzle provided below the supply part. The nozzle is provided with a flow path defined by an inner circumferential surface of the nozzle through which the molten metal supplied from the supply part can pass. The inner circumferential surface of the nozzle has a gradually reducing inner diameter portion whose inner diameter is gradually reduced in a downward direction. The nozzle is further provided with an orifice opened at a bottom end of the flow path and adapted to inject water toward the flow path. The nozzle has a first member having the gradually reducing inner diameter portion and a second member provided below the first member with a space left between the first member and the second member. The orifice is defined by the first member and the second member. A heat absorption body is provided on the first member. The absorption body serves as a restraint means for, when heated, deforming a surrounding region of the gradually reducing inner diameter portion of the first member to thereby restrain the orifice from being enlarged by the pressure of the water passing through the orifice.

13 Claims, 3 Drawing Sheets

METAL POWDER PRODUCTION APPARATUS

CROSS-REFERENCE TO RELATED APPLICATION

This application claims a priority to Japanese Patent Application No. 2005-367228 filed on Dec. 20, 2005 which is hereby expressly incorporated by reference herein in its entirety.

BACKGROUND

1. Technical Field

The present invention relates to a metal powder production apparatus for producing metal powder from molten metal.

2. Related Art

Conventionally, a metal powder production apparatus (atomizer) that pulverizes molten metal into metal powder by an atomizing method has been used in producing metal powder. Examples of the metal powder production apparatus known in the art include a molten metal atomizing and pulverizing apparatus disclosed in JP-B-3-55522.

The molten metal atomizing and pulverizing apparatus is provided with a molten bath nozzle for ejecting molten bath (molten metal) in a downward direction and a water nozzle having a flow path through which the molten bath ejected from the molten bath nozzle passes and a slit opened into the flow path. Water is injected from the slit of the water nozzle.

The apparatus of the prior art mentioned above is designed to produce metal powder by bringing the molten bath passing through the flow path into collision with the water injected from the slit to thereby disperse the molten bath in the form of a multiplicity of fine liquid droplets and then allowing the multiplicity of fine liquid droplets to be cooled and solidified.

However, in the apparatus of the prior art mentioned above, the clearance of the slit is excessively enlarged by the pressure of the water flowing therethrough. As a result, water pressure is dropped in the water nozzle. This water pressure drop causes a problem of overly reducing the flow velocity of the water injected from the slit. Therefore, since the ability for the fast-flowing water to pulverize the molten bath is decreased, fine-sizing of the metal powder cannot be made. This makes it difficult to obtain fine powder of a desired particle size.

SUMMARY

Accordingly, it is an object of the present invention to provide a metal powder production apparatus capable of maintaining a flow velocity of fluid injected from an orifice nearly constant in a reliable manner.

One aspect of the invention is directed to a metal powder production apparatus. The metal powder production apparatus comprises a supply part for supplying molten metal and a nozzle provided below the supply part. The nozzle includes a flow path defined by an inner circumferential surface of the nozzle through which the molten metal supplied from the supply part can pass, the inner circumferential surface of the nozzle having a gradually reducing inner diameter portion whose inner diameter is gradually reduced in a downward direction, an orifice opened at a bottom end of the flow path and adapted to inject fluid toward the flow path, a retention portion for temporarily retaining the fluid, and an introduction path for introducing the fluid from the retention portion to the orifice.

The molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder.

Further, the nozzle includes a first member having the gradually reducing inner diameter portion and a second member provided below the first member with a space left between the first member and the second member. The orifice, the retention portion and the introduction path are defined by the first member and the second member. A restraint means for, when heated, deforming a surrounding region of the gradually reducing inner diameter portion of the first member to thereby restrain the orifice from being enlarged by the pressure of the fluid passing through the orifice is provided on or in the first member.

According to the above metal powder production apparatus, since a surrounding region of the gradually reducing inner diameter portion of the first member can be deformed under an action of the restraint means, the orifice is prevented from being enlarged by the pressure of the fluid passing through the orifice. This makes it possible to maintain the flow velocity of the fluid injected from the orifice nearly constant in a reliable manner.

It is preferred that the orifice is opened in a circumferential slit shape extending over the inner circumferential surface of the nozzle.

This ensures that the fluid is injected in a generally conical contour with an apex thereof lying definitely at the lower side.

It is preferred that the orifice has an inner circumferential surface defined by the first member and an outer circumferential surface defined by the second member.

This makes it possible to easily and reliably form the orifice. Furthermore, the size of the orifice can be properly set in accordance with the size of the space left between the first member and the second member.

It is preferred that the orifice is configured to ensure that the fluid is injected in a generally conical contour with an apex lying at a lower side.

This ensures that the molten metal is dispersed within the fluid injected in a generally conical contour and is turned to a multiplicity of fine liquid droplets in a reliable manner.

It is preferred that the introduction path has a vertical cross-section of a wedge shape.

This makes it possible to gradually increase the flow velocity of the fluid. It is also possible to stably inject the fluid having an increased velocity from the orifice.

It is preferred that the gradually reducing inner diameter portion is of a convergent shape.

This ensures that the air subsisting above the nozzle flows into (or is sucked up into) the gradually reducing inner diameter portion together with the stream of fluid injected from an orifice. The air thus introduced exhibits a greatest flow velocity near a smallest inner diameter section of the gradually reducing inner diameter portion. Under an action of the air whose flow velocity has become greatest, the molten metal is dispersed and turned to a multiplicity of fine liquid droplets in a reliable manner.

It is preferred that the restraint means comprises a heat absorption body formed on the gradually reducing inner diameter portion over an entire circumference thereof, the heat absorption body made of a material greater in thermal expansion coefficient than the first member, and the heat absorption body is expanded to outwardly push the gradually reducing inner diameter portion by absorbing radiant heat from the molten metal passing through the flow path.

This makes it possible to maintain the flow velocity of the fluid injected from the orifice nearly constant in more reliable manner.

It is preferred that the heat absorption body has a thickness of 5-20 mm.

If the thickness of the heat absorption body falls within the above numerical value range, the degree of expansion of the heat absorption body becomes proper, thus making it possible to maintain the size of the orifice constant in a reliable manner. Consequently, the flow velocity of the fluid injected from the orifice can be kept constant more reliably.

It is preferred that difference between a thermal expansion coefficient of the heat absorption body and a thermal expansion coefficient of the first member and/or the second member is equal to or greater than $4\times10^{-6}$ °C.$^{-1}$.

If the thermal expansion coefficient of the heat absorption body falls within the above numerical value range, the degree of expansion of the heat absorption body becomes proper, thus making it possible to maintain the size of the orifice constant in a reliable manner. Consequently, the flow velocity of the fluid injected from the orifice can be kept constant more reliably.

It is preferred that the heat absorption body is mainly composed of stainless steel.

This ensures that the heat absorption body is thermally expanded by the radiant heat in a reliable manner, whereby the inner circumferential surface of the gradually reducing inner diameter portion can be outwardly pushed in a reliable manner.

It is preferred that the restraint means comprises a heating body for, when energized, generating heat to expand and deform a part of the gradually reducing inner diameter portion.

This makes it possible to maintain the flow velocity of the fluid injected from the orifice nearly constant in more reliable manner.

It is preferred that the heating body is embedded in the first member.

This makes it possible to maintain the flow velocity of the fluid injected from the orifice nearly constant in more reliable manner.

It is preferred that the heating body is positioned above the introduction path.

This provides an advantage that the heating body works well, because the closer to the open end of the orifice the position of the heating body is located, the greater the influence exercised against the strain of the orifice becomes.

The above and other objects, features and advantages of the present invention will become apparent from the following description of preferred embodiments given in conjunction with the accompanying drawings.

DESCRIPTION OF EXEMPLARY EMBODIMENTS

Hereinafter, a metal powder production apparatus in accordance with the present invention will be described in respect of preferred embodiments shown in the accompanying drawings.

First Embodiment

Figure 1:
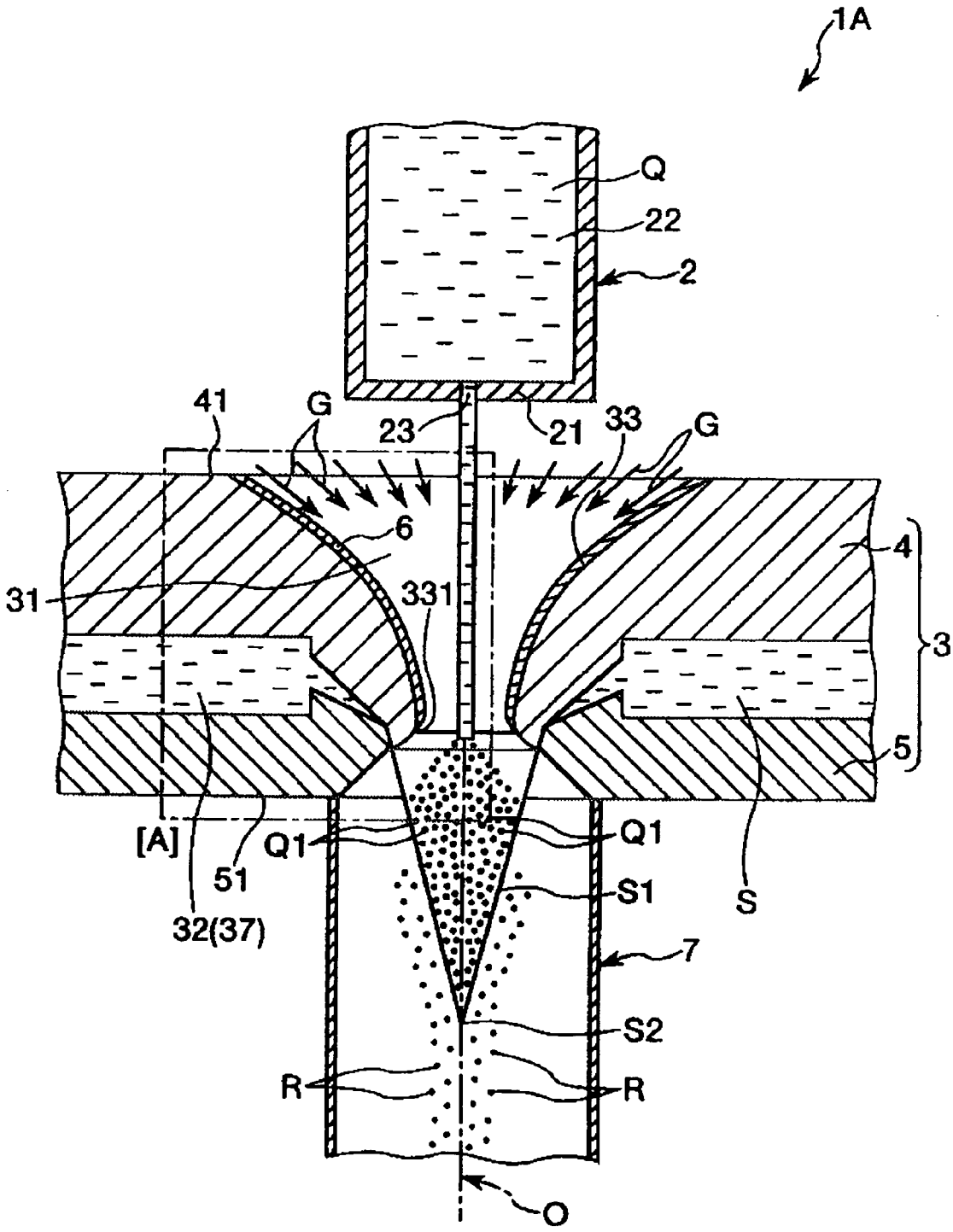
FIG. 1 is a vertical sectional view showing a metal powder production apparatus in accordance with a first embodiment of the present invention.
Figure 2:
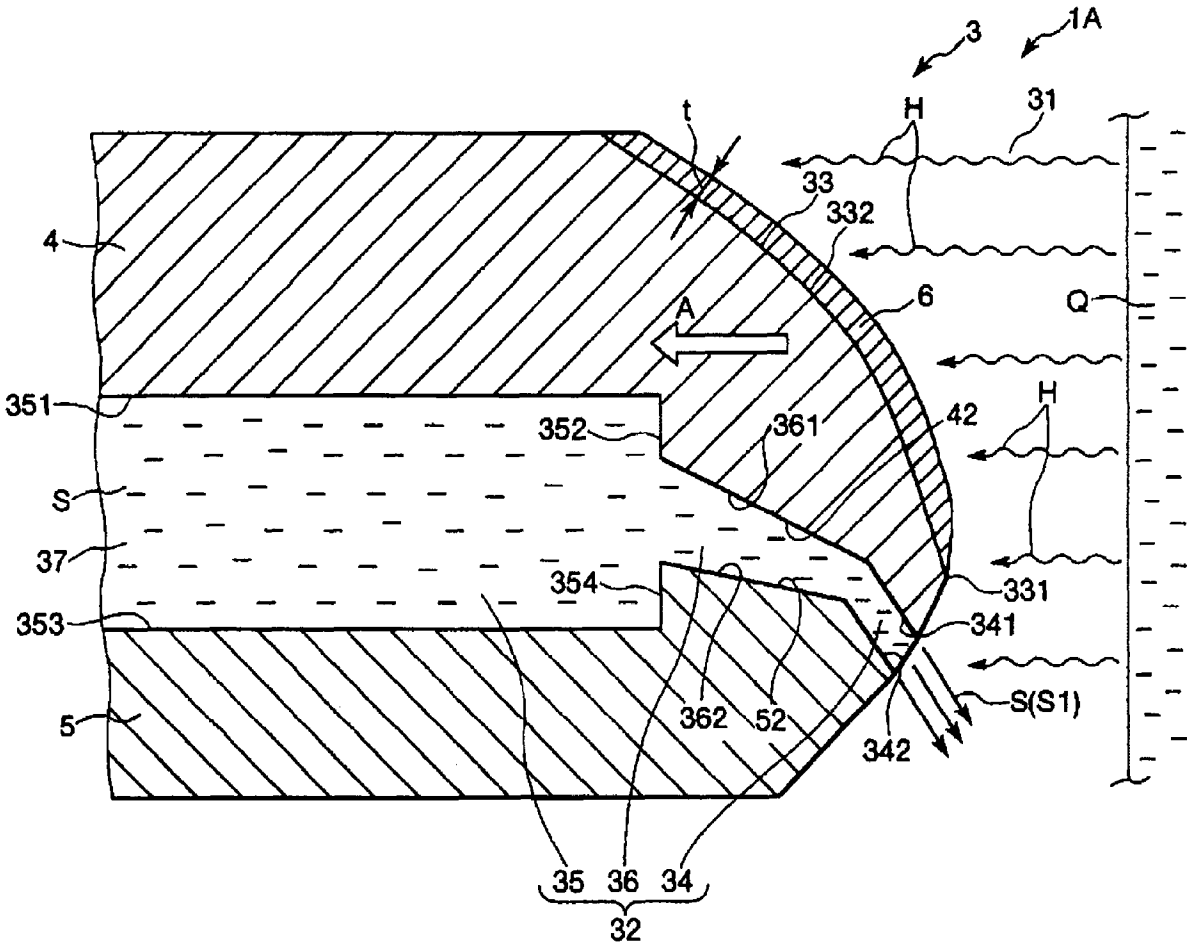
FIG. 2 is an enlarged detail view of a region [A] enclosed by a single-dotted chain line in FIG. 1.

FIG. 1 is a vertical sectional view showing a metal powder production apparatus in accordance with a first embodiment of the present invention, FIG. 2 is an enlarged detail view of a region [A] enclosed by a single-dotted chain line in FIG. 1.

In the following description, the upper side in FIGS. 1 and 2 will be referred to as "top" or "upper" and the lower side will be referred to as "bottom" or "lower", only for the sake of better understanding.

The metal powder production apparatus (atomizer) 1A shown in FIG. 1 is an apparatus that pulverizes molten metal Q by an atomizing method to obtain a multiplicity of metal powder particles R. The metal powder production apparatus 1A includes a supply part 2 for supplying the molten metal Q, a nozzle 3 provided below the supply part 2, a heat absorption body 6 attached to the nozzle 3 and serving as a restraint means, and a cover 7 attached to a bottom end surface 51 of the nozzle 3 (namely, the second member 5).

Taken as an example in the present embodiment is a case that the metal powder production apparatus 1A produces metal powder particles R made of stainless steel (e.g., 304L, 316L, 17-4PH, 440C or the like) or Fe—Si-based magnetic material.

Now, description will be given to the configuration of individual parts.

As shown in FIG. 1, the supply part 2 has a portion of a bottom-closed tubular shape. In an internal space (cavity portion) 22 of the supply part 2, there is temporarily stored the molten metal Q (a molten material) obtained by mixing a simple substance of Co and a simple substance of Sn at a predetermined mol ratio (e.g., a mol ratio of 1:2) and melting them.

Furthermore, an ejection port 23 is formed at the center of a bottom portion 21 of the supply part 2. The molten metal Q in the internal space 22 is downwardly ejected from the ejection port 23.

The nozzle 3 is arranged below the supply part 2. The nozzle 3 is provided with a first flow path 31 through which the molten metal Q supplied (ejected) from the supply part 2 passes and a second flow path 32 through which water S supplied from a water source (not shown) for supplying water (liquid) S passes.

The first flow path 31 has a circular cross-section and extends in a vertical direction at the center of the nozzle 3. The first flow path 31 is defined by an inner circumferential surface of the nozzle 3. The inner circumferential surface of the nozzle 3 has a gradually reducing inner diameter portion 33 of a convergent shape whose inner diameter is gradually decreased from a top end surface 41 of the nozzle 3 toward the bottom thereof. Specifically a first member 4 which will be described hereinafter has the gradually reducing inner diameter portion 33.

Thus, the air (gas) G subsisting above the nozzle 3 flows into (or is sucked up into) the gradually reducing inner diameter portion 33 (the first flow path 31) together with the stream of water (fluid) S injected from an orifice 34, which will be describe later. The air G thus introduced exhibits a greatest flow velocity near a smallest inner diameter section 331 of the gradually reducing inner diameter portion 33 (near a section at which the orifice 34 is opened). Under an action of the air G whose flow velocity has become greatest, the molten metal Q is dispersed and turned to a multiplicity of fine liquid droplets Q1 in a reliable manner.

As illustrated in FIG. 2, the second flow path 32 is formed of an orifice 34 opened toward a bottom end portion (the vicinity of the smallest inner diameter section 331) of the first flow path 31, a retention portion 35 for temporarily retaining the water S, and an introduction path (interconnecting path) 36 through which the water S is introduced from the retention portion 35 into the orifice 34.

The retention portion 35 is connected to the water source to receive the water S therefrom. The retention portion 35 communicates with the orifice 34 through the introduction path 36. Furthermore, the retention portion 35 has a vertical cross-section of a rectangular (or square) shape.

The introduction path 36 is a region whose vertical cross-section is of a wedge-like shape. This makes it possible to gradually increase the flow velocity of the water S flowing into the introduction path 36 from the retention portion 35 and, hence, to stably inject the water S with an increased flow velocity from the orifice 34.

The orifice 34 is a region at which the water S passed the retention portion 35 and the introduction path 36 in sequence is injected or spouted into the first flow path 31.

The orifice 34 is opened in a circumferential slit shape extending over the inner circumferential surface of the nozzle 3. Furthermore, the orifice 34 is opened in an inclined direction with respect to a center axis O of the first flow path 31.

By virtue of the orifice 34 formed in this manner, the water S is injected as a liquid jet S1 of a generally conical contour with an apex S2 thereof lying definitely at the lower side (see FIG. 1). This ensures that, in and inside the liquid jet S1, the molten metal Q is dispersed and turned to the multiplicity of fine liquid droplets Q1 in a reliable manner.

As set forth above, the molten metal Q is further dispersed and turned to the multiplicity of fine liquid droplets Q1 in a reliable manner, by the Air G whose flow velocity becomes greatest near the smallest inner diameter section 331 of the gradually reducing inner diameter portion 33. This generates a synergistic effect by which the molten metal Q is reliably dispersed and turned to the multiplicity of fine liquid droplets Q1 in more reliable manner.

The molten metal Q turned to the multiplicity of liquid droplets Q1 is cooled and solidified by making contact with the liquid jet S1, whereby a multiplicity of metal powder particles R are produced. The multiplicity of metal powder particles R thus produced are received in a container (not shown) arranged below the metal powder production apparatus 1A.

The nozzle 3 in which the first flow path 31 and the second flow path 32 are formed includes a first member 4 of a disk-like shape (ring-like shape) and a second member 5 of a disk-like shape (ring-like shape) arranged concentrically with the first member 4 (see FIGS. 1 and 2). The second member 5 is arranged below the first member 4 with a space 37 left therebetween.

The orifice 34, the introduction path 36 and the retention portion 35 are respectively defined by the first member 4 and the second member 5 arranged in this way. That is to say, the second flow path 32 is provided by the space 37 formed between the first member 4 and the second member 5.

As illustrated in FIG. 2, the orifice 34 has an inner circumferential surface 341 defined by a bottom portion 42 of the first member 4 and an outer circumferential surface 342 defined by a top portion 52 of the second member 5.

Likewise, the introduction path 36 has an upper surface 361 defined by the bottom portion 42 of the first member 4 and a lower surface 362 defined by the top portion 52 of the second member 5.

Moreover, the retention portion 35 has an upper surface 351 and an inner circumferential surface 352 lying above the introduction path 36, both of which are defined by the bottom portion 42 of the first member 4, and a lower surface 353 and an inner circumferential surface 354 lying below the introduction path 36, both of which are defined by the top portion 52 of the second member 5.

By defining the orifice 34, the introduction path 36 and the retention portion 35 in this manner, it is possible to easily and reliably form the orifice 34, the introduction path 36 and the retention portion 35 in the nozzle 3. Furthermore, the size of the orifice 34, the introduction path 36 and the retention portion 35 can be properly set in accordance with the size of the space 37.

Examples of a constituent material of the first member 4 and the second member 5 include, but are not particularly limited to, a variety of metallic materials. In particular, use of stainless steel is preferred, and use of Cr-based stainless steel or precipitation hardening stainless steel is more preferred.

As shown in FIG. 1, the cover 7 formed of a tubular body is fixedly secured to a bottom end surface 51 of the second member 5. The cover 7 is arranged concentrically with the first flow path 31. Use of the cover 7 makes it possible to prevent the metal powder particles R from flying apart as they fall down, whereby the metal powder particles R can be reliably received the container.

As illustrated in FIG. 2 (also in FIG. 1), the heat absorption body 6 is formed at (bonded to) the gradually reducing inner diameter portion 33 of the first member 4. The heat absorption body 6 functions as a restraint means for restraining enlargement of the orifice 34 which would otherwise be caused by the pressure of the water S passing through the orifice 34.

The heat absorption body 6 is formed on the gradually reducing inner diameter portion 33 in such a manner as to have a uniform thickness "t" over the entire circumference thereof. Moreover, the heat absorption body 6 is made of a material greater in thermal expansion coefficient than the first member 4.

Such a heat absorption body 6 absorbs radiant heat H from the molten metal Q passing through the first flow path 31 and expands as the internal temperature thereof grows higher. Thus, the gradually reducing inner diameter portion 33 is pressed outwardly, i.e., in the direction indicated by an arrow "A" in FIG. 2, thereby displacing (deforming) the gradually reducing inner diameter portion 33 as a whole in the direction indicated by the arrow "A".

With the metal powder production apparatus 1A of the configuration noted above, as the water S is injected from the orifice 34, the inner circumferential surface 341 and the outer circumferential surface 342 are pushed in such directions as to move away from each other, by the pressure of the water S passing through the orifice 34. As a result, the orifice 34 is urged to become enlarged.

However, the inner circumferential surface 341 and the outer circumferential surface 342 are restrained from moving away from each other, because the gradually reducing inner diameter portion 33 is displaced as a whole in the arrow "A" direction under the action of the heat absorption body 6 expanded by the radiant heat H from the molten metal Q. This keeps the orifice 34 from being enlarged. Thus, once the heat absorption body 6 is brought into a normal expansion state (stabilized expansion state), it becomes possible to maintain the size of the orifice 34 constant, whereby the flow velocity of the water S injected from the orifice 34 can be kept constant in a reliable manner.

The thickness "t" of the heat absorption body 6 may preferably be, e.g., 5-20 mm, and more preferably 5-10 mm, although not particularly limited thereto.

If the thickness "t" falls within the afore-mentioned numerical value range, the degree of expansion of the heat absorption body 6 becomes proper, thus making it possible to maintain the size of the orifice 34 constant in a reliable manner. Consequently, the flow velocity of the water. S injected from the orifice 34 can be kept constant reliably.

Difference between the thermal expansion coefficient of the heat absorption body 6 and the thermal expansion coefficient of the first member 4 and/or the second member 5 may preferably be, e.g., equal to or greater than $4\times10^{-6\circ}$ C.$^{-1}$, and more preferably equal to or greater than $2\times10^{-6\circ}$ C.$^{-1}$, although not particularly limited thereto.

If the difference in thermal expansion coefficient falls within the afore-mentioned numerical value range, it is possible to ensure that the flow velocity of the water S injected from the orifice 34 is kept constant in more reliable manner, just like the case that the thickness "t" falls within the afore-mentioned numerical value range.

Preferably, the heat absorption body 6 is mainly composed of, e.g., austenitic stainless steel, although not particularly limited thereto.

This enables the heat absorption body 6 to be reliably expanded by the radiant heat H, whereby the gradually reducing inner diameter portion 33 can be reliably compressed in the arrow "A" direction.

Furthermore, the heat absorption body 6 may be formed on the gradually reducing inner diameter portion 33, e.g., by spraying a molten constituent material of the heat absorption body 6 on the inner circumferential surface 332 (the gradually reducing inner diameter portion 33) by a thermal spray method and solidifying the constituent material thus sprayed, although not particularly limited thereto.

Second Embodiment

Figure 3:
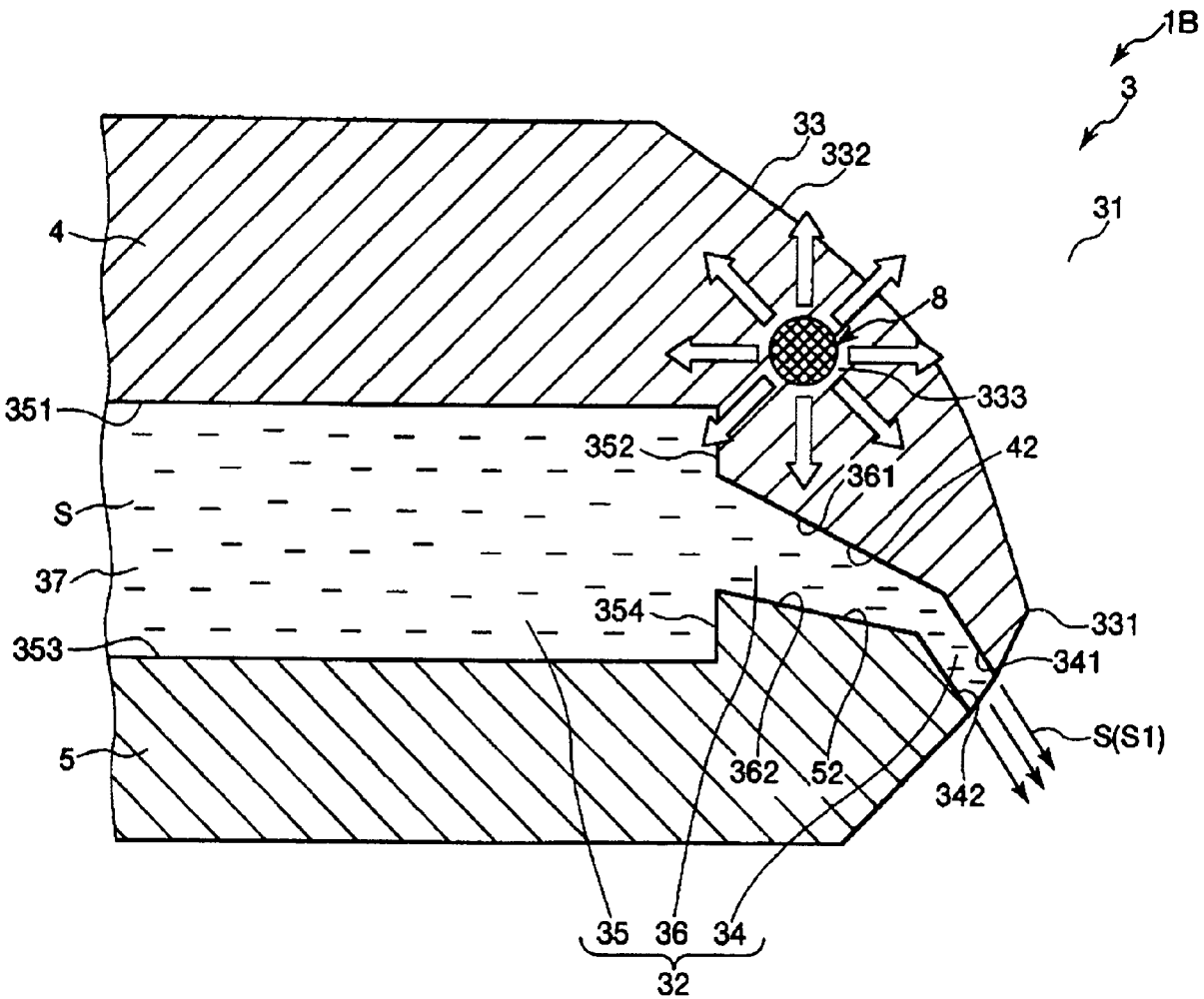
FIG. 3 is a vertical sectional view showing a metal powder production apparatus in accordance with a second embodiment of the present invention.

FIG. 3 is a vertical sectional view showing a metal powder production apparatus in accordance with a second embodiment of the present invention.

In the following description, the upper side in FIG. 3 will be referred to as "top" or "upper" and the lower side will be referred to as "bottom" or "lower", only for the sake of better understanding.

Hereinafter, a metal powder production apparatus in accordance with a second embodiment of the present invention will be described with reference to this figure. The following description will be centered on the points differing from the foregoing embodiments, with the same points omitted from description.

The present embodiment is the same as the first embodiment, except for difference in the configuration of a restraint means.

A heating body (heater) 8 that serves as a restraint means for restraining enlargement of the orifice 34 is embedded in the first member 4 (near the gradually reducing inner diameter portion 33) of the nozzle 3 of the metal powder production apparatus 1B shown in FIG. 3. The heating body 8 is electrically connected to a power feeding part (not shown) for feeding an electric power and is adapted to generate heat, when energized.

With the metal powder production apparatus 1B of this configuration, a surrounding region 333 of the first member 4 around the heating body 8 (the vicinity of the heating body 8) is heated upon generation of heat by the heating body 8.

The surrounding region 333 thus heated is expanded and deformed in the direction indicated by arrows in FIG. 3. This restrains the inner circumferential surface 341 and the outer circumferential surface 342 from moving away from each other. Namely, enlargement of the orifice 34 is restrained. Thus, once the surrounding region 333 is brought into a normal expansion state (stabilized expansion state), it becomes possible to maintain the size of the orifice 34 constant, whereby the flow velocity of the water S injected from the orifice 34 can be kept constant in a reliable manner.

As can be seen in FIG. 3, it is preferred that the heating body 8 is positioned above the introduction path 36.

This provides an advantage that the heating body 8 works well, because the closer to the tip end (open end) of the orifice 34 the position of the heating body 8 is located, the greater the influence exercised against the strain of the orifice 34 becomes.

It is also preferred that the heating body 8 is operated in synchronism with the injection of the water S from the orifice 34.

While the metal powder production apparatus of the present invention has been described hereinabove in respect of the illustrated embodiments, the present invention is not limited thereto. Individual parts constituting the metal powder production apparatus may be substituted by other arbitrary ones capable of performing like functions. Moreover, arbitrary constituent parts may be added if necessary.

In addition, although the liquid (fluid) injected from the nozzle is water in the foregoing embodiments, the present invention is not limited thereto. The liquid may be, e.g., lipids or solvents.

What is claimed is:

1. A metal powder production apparatus comprising:

a supply part for supplying molten metal;

a nozzle provided below the supply part, the nozzle including a flow path defined by an inner circumferential surface of the nozzle through which the molten metal supplied from the supply part can pass, the inner circumferential surface of the nozzle having a gradually reducing inner diameter portion whose inner diameter is gradually reduced in a downward direction, an orifice opened at a bottom end of the flow path and adapted to inject fluid toward the flow path, a retention portion for temporarily retaining the fluid, and an introduction path for introducing the fluid from the retention portion to the orifice, the nozzle including a first member having the gradually reducing inner diameter portion and a second member provided below the first member with a space left between the first member and the second member, wherein the orifice, the retention portion and the introduction path are defined by the first member and the second member; and a restraint means for, when heated, deforming a surrounding region of the gradually reducing inner diameter portion of the first member to thereby restrain the orifice from being enlarged by the pressure of the fluid passing through the orifice, the restraint means being provided on or in the first member, whereby the molten metal is dispersed and turned into a multiplicity of fine liquid droplets by bringing the molten metal passing through the flow path into contact with the fluid injected from the orifice of the nozzle, so that the multiplicity of fine liquid droplets are solidified to thereby produce metal powder.

2. The metal powder production apparatus as claimed in claim 1, wherein the orifice is opened in a circumferential slit shape extending over the inner circumferential surface of the nozzle.

3. The metal powder production apparatus as claimed in claim 1, wherein the orifice is configured to ensure that the fluid is injected in a generally conical contour with an apex lying at a lower side.

4. The metal powder production apparatus as claimed in claim 3, wherein the orifice has an inner circumferential surface defined by the first member and an outer circumferential surface defined by the second member.

5. The metal powder production apparatus as claimed in claim 1, wherein the introduction path has a vertical cross-section of a wedge shape.

6. The metal powder production apparatus as claimed in claim 1, wherein the gradually reducing inner diameter portion is of a convergent shape.

7. The metal powder production apparatus as claimed in claim 1, wherein the restraint means comprises a heat absorption body formed on the gradually reducing inner diameter portion over an entire circumference thereof, the heat absorption body made of a material greater in thermal expansion coefficient than the first member, and wherein the heat absorption body is expanded to outwardly push the gradually reducing inner diameter portion by absorbing radiant heat from the molten metal passing through the flow path.

8. The metal powder production apparatus as claimed in claim 7, wherein the heat absorption body has a thickness of 5-20 mm.

9. The metal powder production apparatus as claimed in claim 7, wherein difference between a thermal expansion coefficient of the heat absorption body and a thermal expansion coefficient of the first member and/or the second member is equal to or greater than $4\times10^{-6}$° C.$^{-1}$.

10. The metal powder production apparatus as claimed in claim 7, wherein the heat absorption body is mainly composed of stainless steel.

11. The metal powder production apparatus as claimed in claim 1, wherein the restraint means comprises a heating body for, when energized, generating heat to expand and deform a part of the gradually reducing inner diameter portion.

12. The metal powder production apparatus as claimed in claim 11, wherein the heating body is embedded in the first member.

13. The metal powder production apparatus as claimed in claim 12, wherein the heating body is positioned above the introduction path.

* * * * *